US009114659B2

(12) United States Patent
Adair et al.

(10) Patent No.: US 9,114,659 B2
(45) Date of Patent: Aug. 25, 2015

(54) SELF-STANDING DESKTOP CALENDAR

(71) Applicant: Archirazzi, LLC, Washington, DC (US)

(72) Inventors: Alison B. Adair, Washington, DC (US); Sheila M. Stone, Williamstown, MA (US); Robert A. Bartle, Stockbridge, MA (US); Paula W. LaBonte, Clarksburg, MA (US); Michael A. Bauer, Riverwoods, IL (US)

(73) Assignee: Archirazzi, LLC, Washington, DC (US)

( * ) Notice: Subject to any disclaimer, the term of this patent is extended or adjusted under 35 U.S.C. 154(b) by 121 days.

(21) Appl. No.: 14/034,489

(22) Filed: Sep. 23, 2013

(65) Prior Publication Data

US 2015/0084325 A1 Mar. 26, 2015

(51) Int. Cl.
*B42D 3/12* (2006.01)
*B42D 5/04* (2006.01)

(52) U.S. Cl.
CPC *B42D 3/12* (2013.01); *B42D 5/043* (2013.01); *B42D 5/045* (2013.01)

(58) Field of Classification Search
CPC ..... B42D 5/043; B42D 5/045
USPC ..... 281/44, 45; 248/441.1, 450; 40/120; D19/20
See application file for complete search history.

(56) References Cited

U.S. PATENT DOCUMENTS 2,228,355 A * 1/1941 Key ..... 402/26
4,793,633 A * 12/1988 Rose, Jr. ..... 281/45
5,379,979 A * 1/1995 Due ..... 281/45

FOREIGN PATENT DOCUMENTS

JP 3169224 * 5/2011

OTHER PUBLICATIONS

JP3169224 Derwent Abstract Translation.*
JP3169224 Derwent Abstract Translation of patent dated May 2011.*
Acrylic calendar stand on Aliexpress.com website.
Acrylic desk calendar stand on Alibaba.com website.
Workman calendars.
Calendars on Andrews McMeel Publishing (andrewsmcmeel.com) website.

* cited by examiner

*Primary Examiner* — Kyle Grabowski
(74) *Attorney, Agent, or Firm* — Chicago IP Law; Steven M. Evans

(57) ABSTRACT

A self-standing desktop calendar having first and second rigid metal panels and a plurality of pages therebetween all being rotatably connected by a spiral ring through a plurality of apertures in the each of the panels and the pages. A planar base is included having opposing parallel sidewalls with slots for receiving the bottoms of the panels to enable the calendar to stand upright on a desk. The sidewalls of the base fit around the bottom of the panels when the calendar is in a closed configuration.

10 Claims, 9 Drawing Sheets

SELF-STANDING DESKTOP CALENDAR

BACKGROUND OF THE INVENTION

1. Field of the Invention

The present invention relates generally calendars and notebooks, and more particularly, to a self-standing desk calendar or multi-page notebook.

2. Description of Related Art

Desk accessories come in all shapes and sizes and perform and provide various functions. One common desk accessory typically located on the top of a desk is a desk calendar. Additionally, one common type of desk calendar is one that lays flat on the top of a desk and covers a substantial portion of the desk. This type of calendar is typically very large so that important events can be written into individual days. However, this large calendar suffers from the inconvenience of taking up significant desktop space and having working items covering the calendar.

Other types of desk calendars can be smaller and also lay flat on the top of the desk, but these calendars are even more difficult to write on and see important information due to their smaller size. There are desk calendars designed to stand upright on a desk, but conventional upright standing calendar designs are unstable, flimsy, and difficult to write on.

Accordingly, there is a need for a desk calendar that is large enough to be easily visible and write on, stands upright to minimize use of valuable desktop surface area, and moreover, has a stable and durable design.

ASPECTS AND SUMMARY OF THE PRESENT INVENTION

One aspect of the present invention is to provide an upright standing calendar for use on a desktop.

Another aspect of the present invention is to provide a self-standing calendar that is very stable and durable.

A further aspect of the present invention is to provide a calendar that can be closed and sealed when not in use or needs to be packed for storage or travel.

An additional aspect of the present invention is to provide a desktop calendar having an attractive as well as a functional design.

In order to provide these aspects and others, the present invention provides a self-standing notebook or calendar having a first rigid panel with a first top and a first bottom. A second rigid panel also is included having a second top and a second bottom, wherein the first top and the second top are rotatably connected. A flat base is included with first and second opposing parallel sidewalls. The first and second opposing parallel sidewalls each have a first slot sized for receiving the first bottom of the first rigid panel and a second slot sized for receiving the second bottom of the second rigid panel. A plurality of pages, each having a third top and a third bottom, are included wherein the third top of the plurality of pages are rotatably connected to the first top of the first rigid panel and the second top of the second rigid panel. The first top of the first panel, the second top of the second rigid panel, and the third top of the plurality of pages preferable are rotatably connected using a spiral ring. The first rigid panel, the second rigid panel, and the base preferably are constructed of a metal, such as aluminum.

The foregoing has outlined, rather broadly, the preferred features of the present invention so that those skilled in the art may better understand the detailed description of the invention that follows. Additional features of the invention will be described hereinafter that form the subject of the claims of the invention. Those skilled in the art should appreciate that they can readily use the disclosed invention and specific embodiments as a basis for designing or modifying other structures for carrying out the same purposes of the present invention, and that such other structures do not depart from the spirit and scope of the invention in its broadest form.

DETAILED DESCRIPTION OF THE PREFERRED EMBODIMENT

Figure 1:
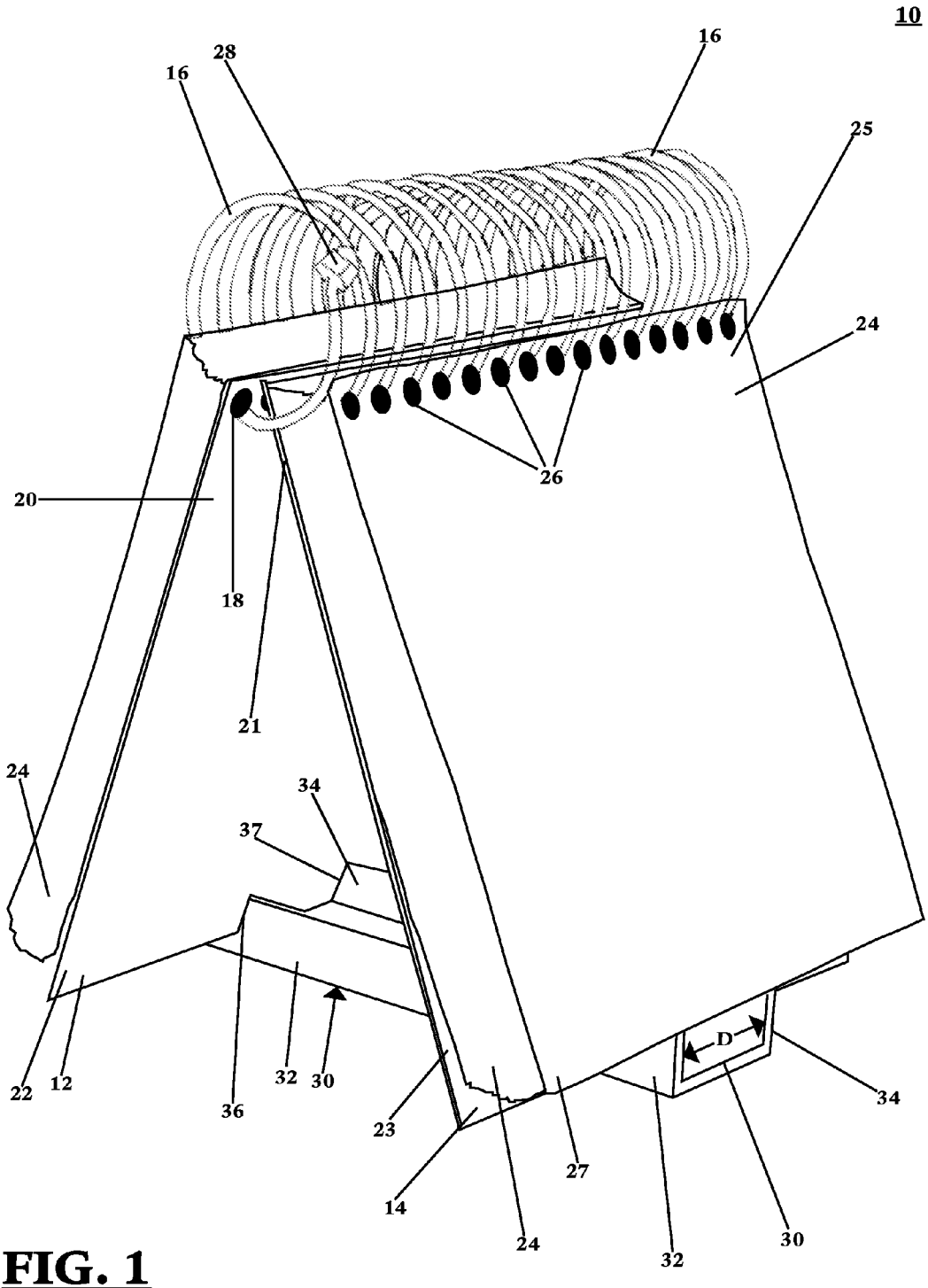
FIG. 1 is a perspective view of a notebook or calendar configured in accordance with the present invention.

Referring now to the drawings, FIG. 1 is a perspective view of a self-standing calendar or notebook 10 configured in accordance with the present invention. The calendar includes a first rigid panel 12 and a second rigid panel 14. The first and second rigid panels 12,14 are preferably flat and have a rectangular configuration. The first and second rigid panels 12,14 are preferably constructed of metal, such as aluminum, but can be constructed of plastic, wood, cardboard, or any other preferably rigid material. The first and second rigid panels 12,14 preferably are identical in size and shape. The first and second rigid panels 12,14 have a first and a second top portion, 20,21, respectively, and a first and a second bottom portion, 22,23, respectively.

The first and second rigid panels 12,14 are rotatably connected together via a ring 16 in the first and second top portions 20,21. In the illustrated embodiment, the ring 16 is a spiral ring 16 rotatably connecting the first and second rigid panels 12,14 via a plurality of apertures 18 each in the first and second top portions 20,21. The plurality of apertures 18 are preferably in a linear row.

A plurality of pages 24 are rotatably connected between the first and second rigid panels 12,14. The plurality of pages 24 have a top portion 25 and a bottom portion 27. The plurality of pages 24 have a plurality of apertures 26 in the top portion 25 for receiving the spiral ring 16 and rotatably connecting the plurality of pages 24 between the first and second rigid panels 12, 14. The plurality of pages 24 is preferably constructed of paper. The plurality of pages 24 can be imprinted with pictures, jokes, dates of a calendar, or other type printing for a bound multiple page item.

The spiral ring 16 is circular and preferably constructed of metal or plastic. The spiral ring 16 fits through the plurality of apertures 18 in the first and second rigid panels 12,14 and the plurality of apertures 26 in the plurality of pages 24. An acorn bold 28 is screwed onto a first end of the spiral ring 16 to prevent the first and second rigid panels 12,14 and the plurality of pages 24 from coming off and disconnecting from the spiral ring 16.

A base 30 having a first and a second sidewall 32,34, respectively, is located below the first and second rigid panels 12,14 in the self-standing configuration. The base 30 is preferably planar so the base 30 can rest flat on a desktop. The base 30 has first and second opposing sidewalls 32,34, respectively. The first and second sidewalls 32,34 at parallel to each other and each include a first slot 36,37, respectively, and a second slot 38,39, (FIG. 7*a*) respectively. The first slots 36,37 are sized for receiving the first bottom portion 22 of the first rigid panel 12, and the second slots 38,39 are sized for receiving the second bottom portion 23 of the second rigid panel 14.

Figure 8:
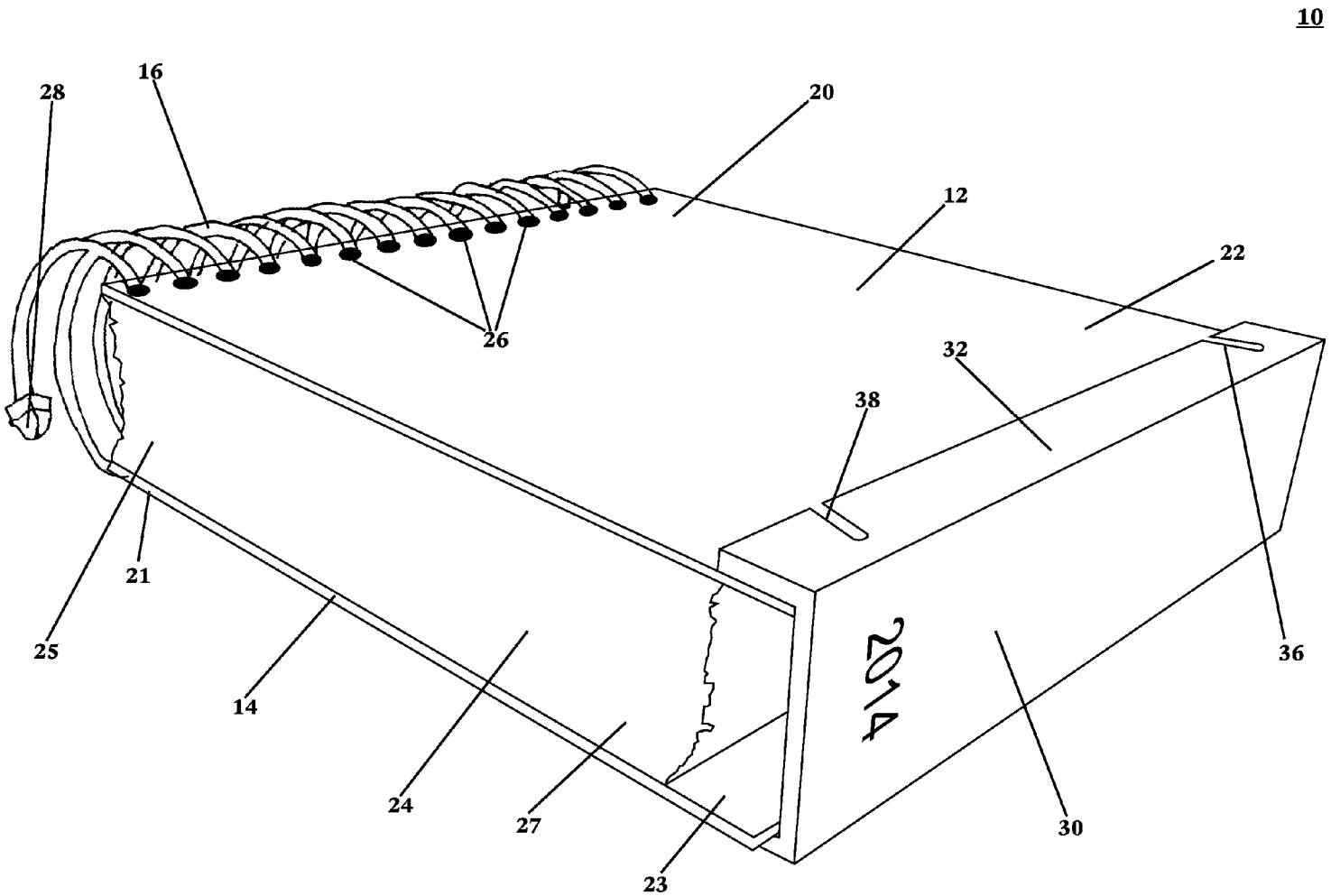
FIG. 8 is a perspective view of the calendar shown in FIG. 1 in the closed configuration and laying on a side.
Figure 9:
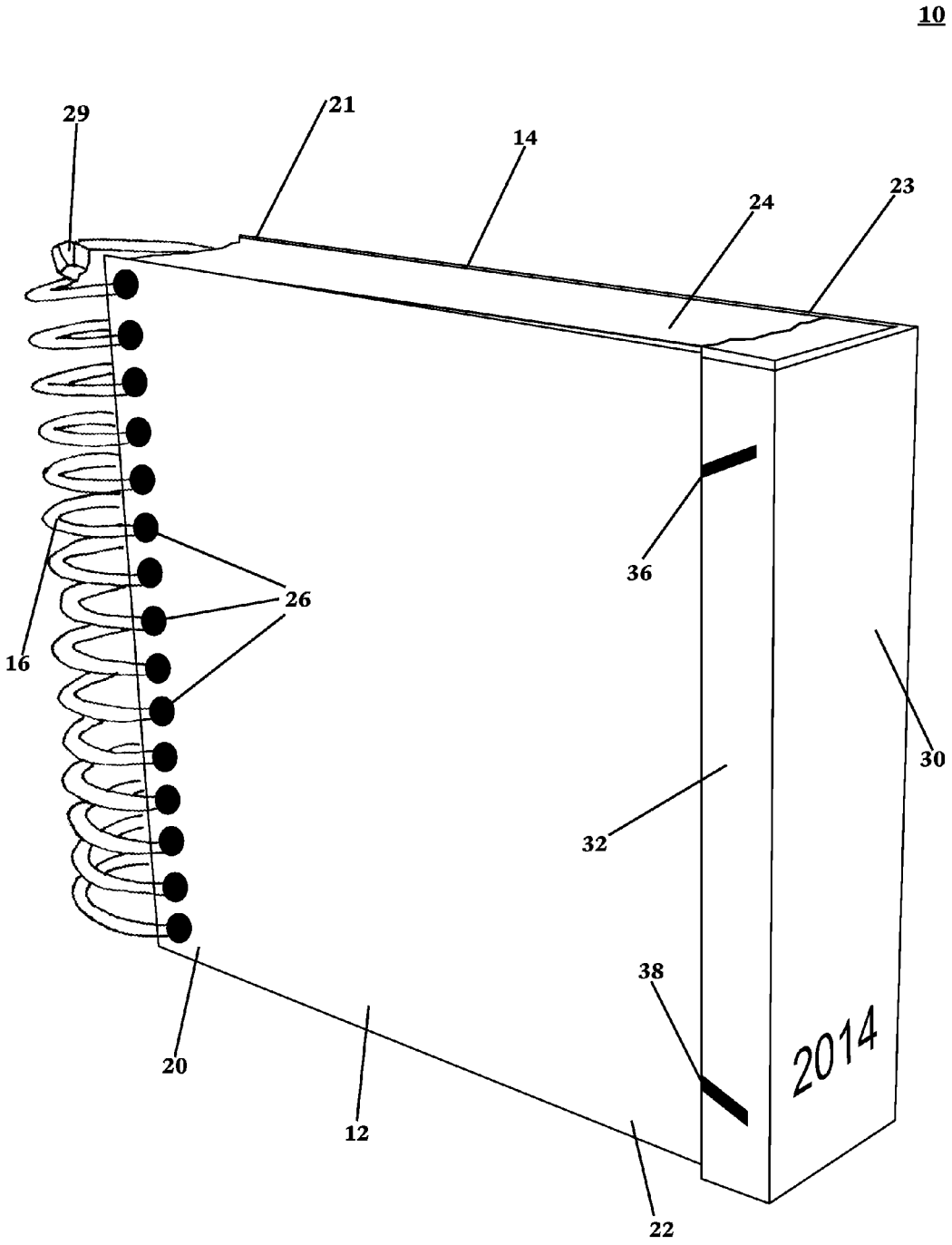
FIG. 9 is a perspective view of the calendar shown in FIGS. 1 and 8 in the closed configuration and standing upright.

The base 30 preferably is constructed of metal, such as aluminum. The distance "D" between the opposing sidewalls 32 and 34 is sized to match the width of the calendar 10 in a closed configuration (FIGS. 8 and 9). This distance D enables the base 30 to cover the bottom portions 22,23 of the calendar 10 in a closed configuration, and remain on the bottom portions 22,23 via friction and a snug fit. The slots 36,37 and 38,39 are slanted inward at an angle corresponding to the angle of the rigid panels 12,14 with respect to the base 30 in the open and self-standing configuration.

Figure 2:
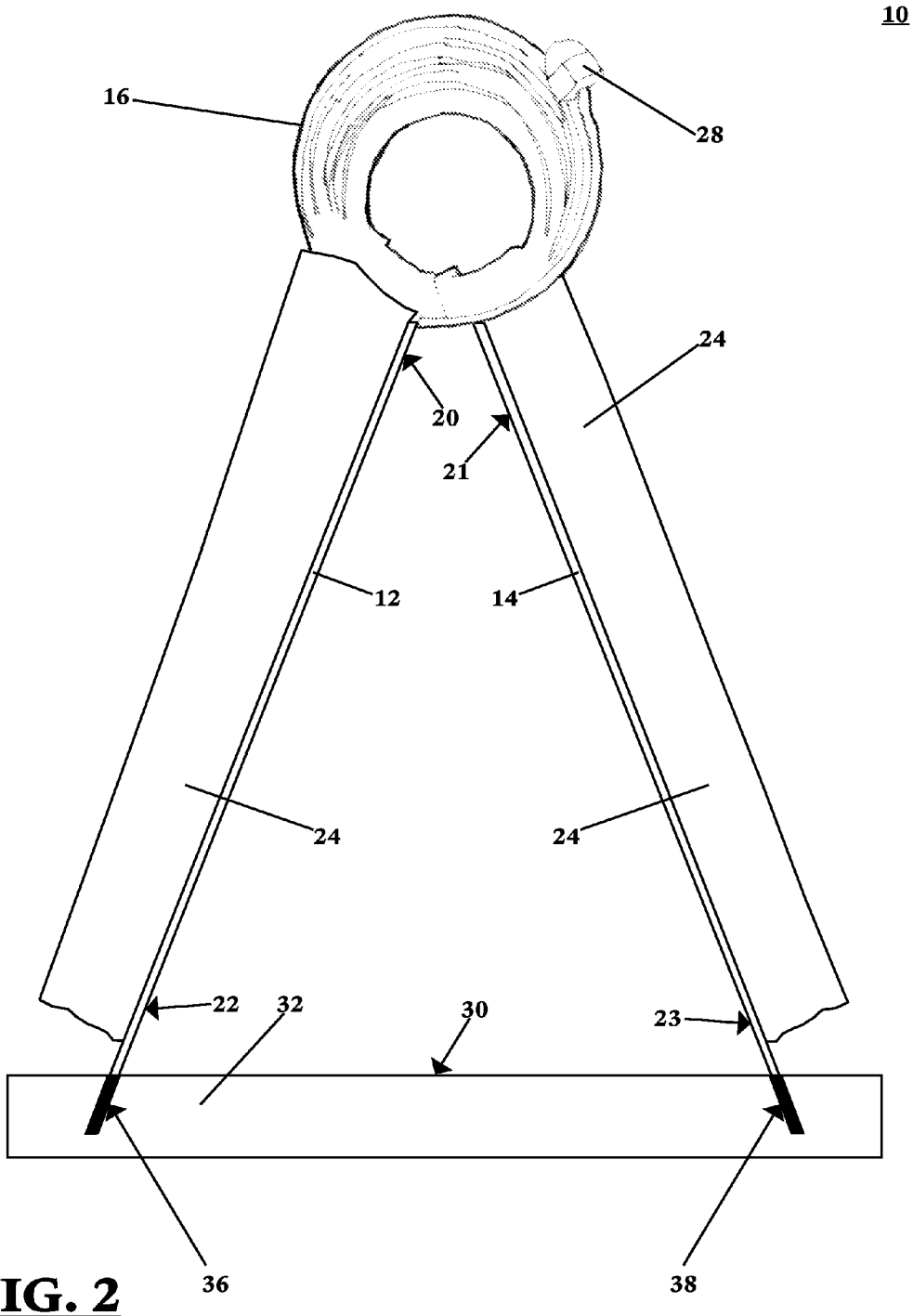
FIG. 2 is a side view of the calendar shown in FIG. 1.

FIG. 2 is a side view of the calendar 10 shown in FIG. 1. Illustrated are the first and second rigid panels 12,14 and the plurality of pages 24. The spiral ring 16 is shown rotatably connecting the first and second rigid panels 12,14 and the plurality of pages 24. The acorn screw nut 28 is shown on an end of the spiral ring 16 to prevent the first and second rigid panels 12,14 and the plurality of pages 24 from coming off or becoming disconnected from the spiral ring 16.

The base 30 is illustrated in FIG. 2 including slots 38 and 36 on the first sidewall 32 of the base 30. The bottom portions 22,23 of the first and second rigid panels 12,14 are shown located within the slots 36,38 in the self-standing configuration of the calendar 10. The slots 36,38 are shown to be at an angle corresponding to the angle of the base 30 relative to the first and second rigid panels 12,14 in the self-standing configuration of the calendar 10. The slots 36,38 are shown to be sized to received the bottom portions 22,23 of the first and second rigid panels 12,14, respectively.

Figure 3:
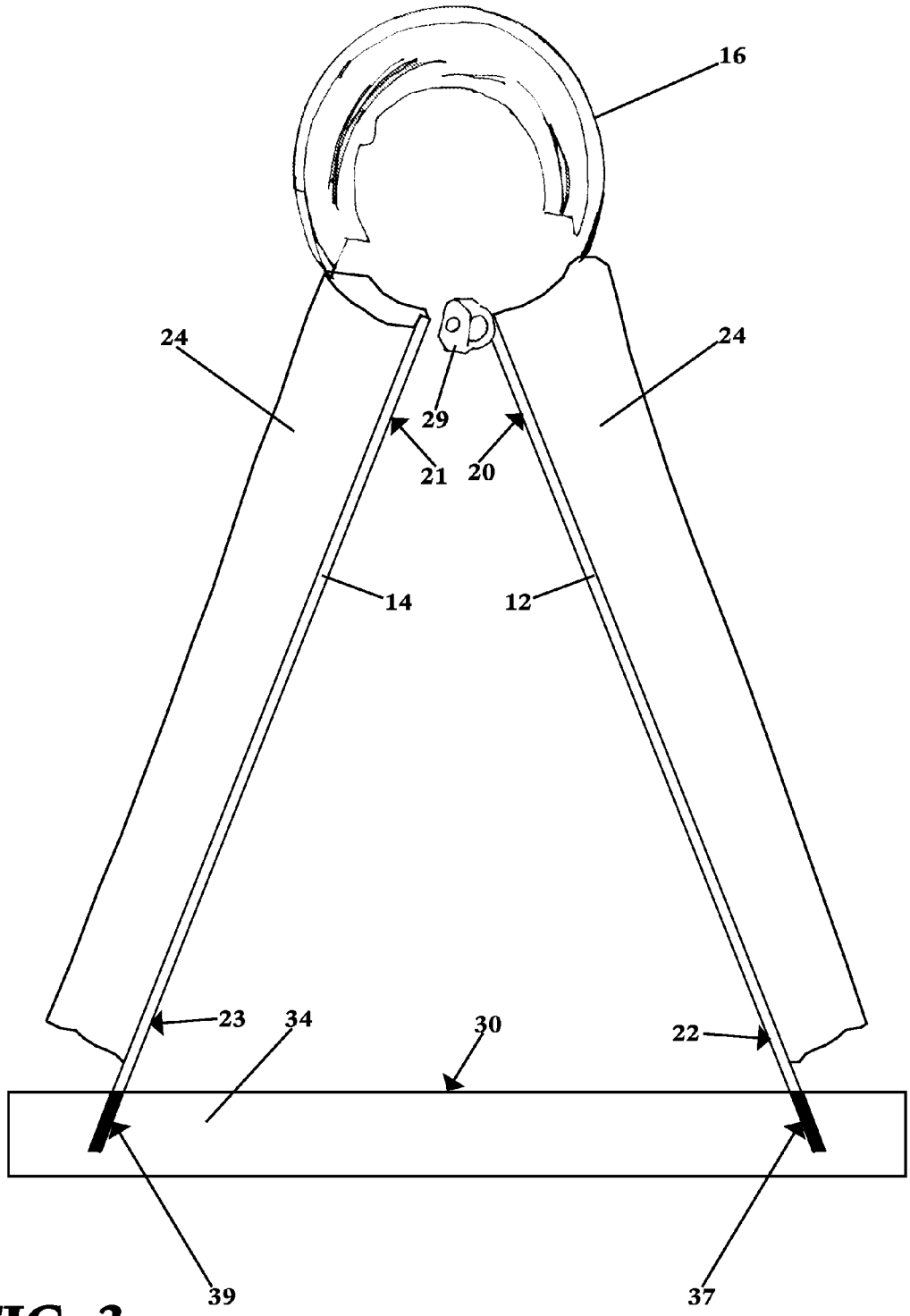
FIG. 3 is a side view of the opposing side of the calendar show in FIG. 2.

FIG. 3 is a side view of the opposite side of the calendar 10 shown in FIG. 2. Illustrated are the first and second rigid panels 12,14 and the plurality of pages 24. The spiral ring 16 is shown rotatably connecting the first and second rigid panels 12,14 and the plurality of pages 24. An acorn screw nut 29 is shown on an end of the spiral ring 16 to prevent the first and second rigid panels 12,14 and the plurality of pages 24 from coming off or becoming disconnected from the spiral ring 16.

The base 30 also is illustrated in FIG. 3. having slots 37 and 39 on the second sidewall 34 of the base 30. The bottom portions 22,23 of the first and second rigid panels 12,14 are shown located within the slots 37,39 in the self-standing configuration of the calendar 10. The slots 37,39 are shown to be at an angle corresponding to the angle of the base 30 relative to the first and second rigid panels 12,14 in the self-standing configuration of the calendar 10. The slots 37,39 are shown to be sized to received the bottom portions 22,23 of the first and second rigid panels 12,14, respectively.

Figure 4:
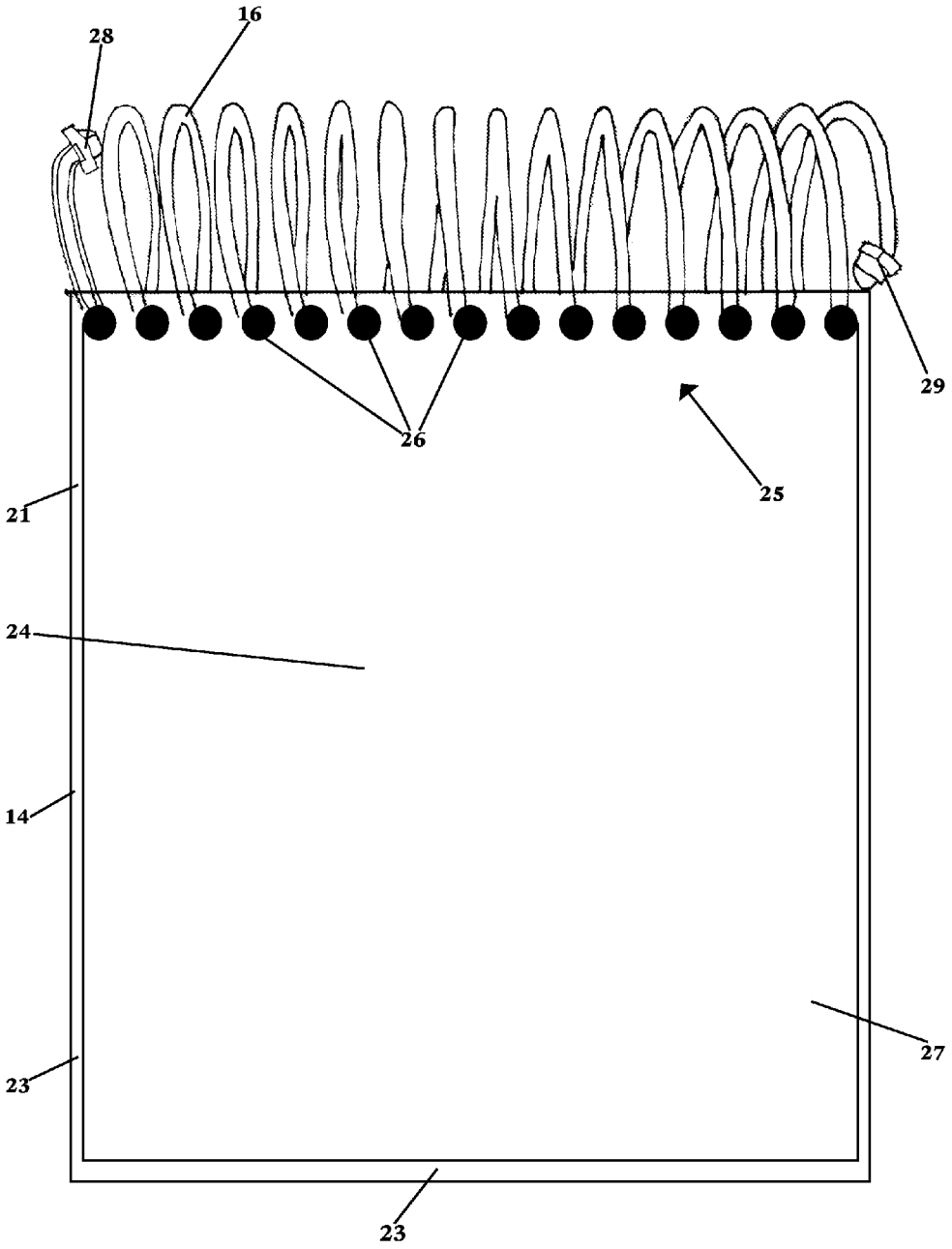
FIG. 4 is a front view of the calendar shown in FIG. 1.

FIG. 4 is a front view of the calendar 10 shown in FIG. 1. The base 30 is not shown in order to more clearly show the plurality of pages 24. FIG. 4 illustrates the spiral ring 16 having acorn screws nuts 28 and 29 on the ends of the spiral ring 16 to prevent the rigid panels 12,14 and the plurality of pages 24 from coming off and becoming disconnected from the spiral ring 16. The plurality of apertures 26 in the plurality of pages 24 further is shown. The third top portion 25 and the third bottom portion 27 of the plurality of pages 24 also is shown. The outer perimeter of the rigid panel 14 also is illustrated showing the top portion 21 and the bottom portion 23.

Figure 5:
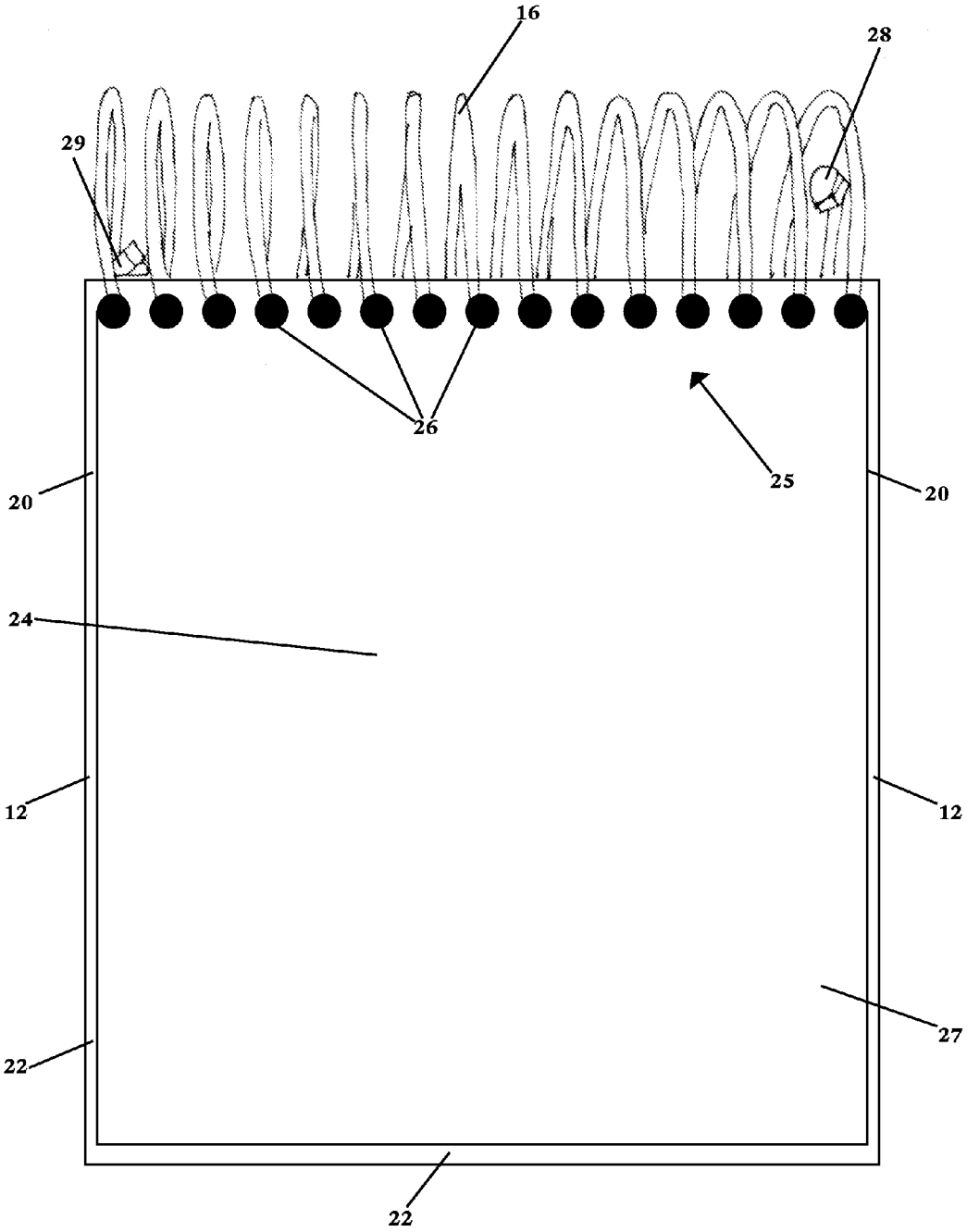
FIG. 5 is a back view of the calendar shown in FIG. 1.

FIG. 5 a back view of the calendar 10 shown in FIG. 1. The base 30 is not shown in order to more clearly show the plurality of pages 24. FIG. 5 illustrates the spiral ring 16 having acorn screws nuts 28 and 29 on the ends of the spiral ring to prevent the rigid panels 12,14 and the plurality of pages 24 from coming off and becoming disconnected from the spiral ring 16. The plurality of apertures 26 in the plurality of page 24 further is shown. The third top portion 25 and the third bottom portion 27 of the plurality of pages 24 also are shown. The outer perimeter of the rigid panel 12 also is illustrated showing the top portion 20 and the bottom portion 22.

Figure 6A:
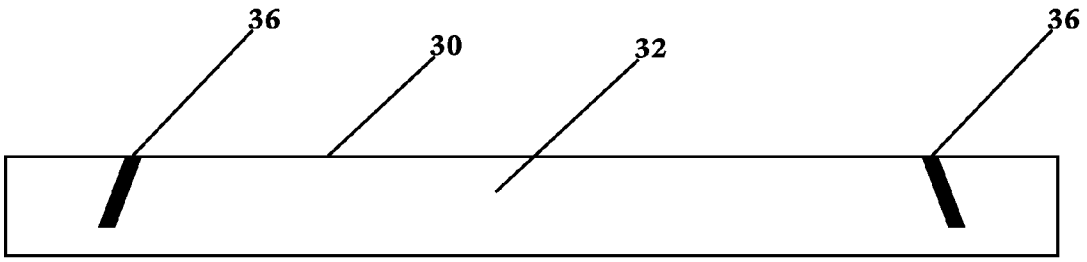
FIG. 6*a* is a side view of a base of the calendar shown in FIG. 1.

FIG. 6*a* is a side view of the sidewall 32 of the base 30 shown in FIG. 1. Also illustrated are the slots 36 and 38 for receiving the first and second rigid panels 12,14, respectively.

Figure 6B:
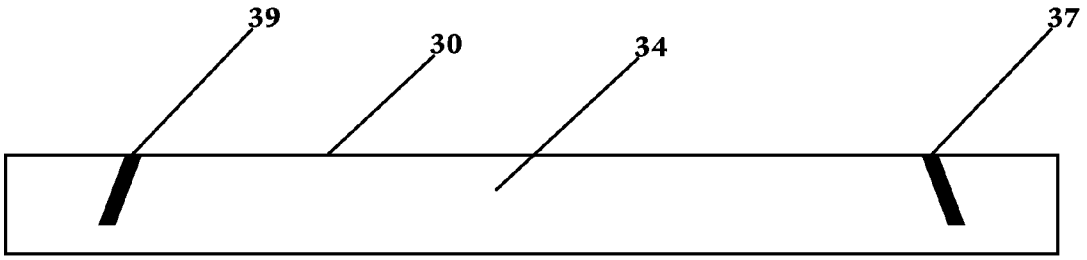
FIG. 6*b* is a side view of the opposing side of the base shown in FIGS. 1 and 6*a;*

FIG. 6*b* a side view of the opposing sidewall 34 of the base 30 shown in FIG. 1. Also illustrated are the slots 37 and 39 for receiving the first and second rigid panels 12,14, respectively.

Figure 7A:
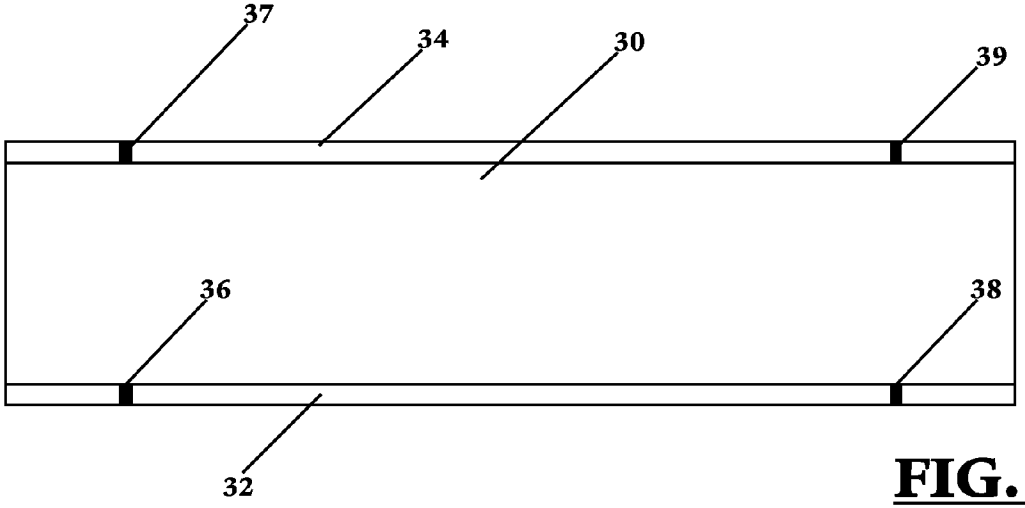
FIG. 7*a* is a top view of the base shown in FIG. 1.

FIG. 7*a* is a top view of the base 30 shown in FIG. 1. Illustrated in FIG. 7*a* are the first and second sidewalls 32,34, and the slots 36,38 and slots 37,39.

Figure 7B:
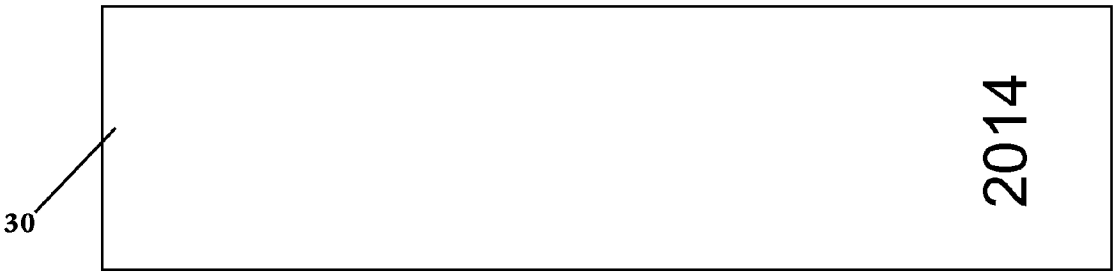
FIG. 7*b* is a bottom view of the base shown in FIG. 1.

FIG. 7*b* is a bottom view of the base 30 shown in FIGS. 1 and 7*a*. In the illustrated embodiment, the example year "2014" for a calendar configuration is imprinted or etched on the bottom of the base 30 for viewing when the calendar 10 is in the closed configuration and ready to be stored, shipped, or placed upright for storage on a shelf.

When in the self-standing configuration as shown in FIG. 1, each page of the plurality of pages 24 of the calendar 10 can be turned over the spiral ring 16 when each day is done. When the year of the calendar is completed, the calendar 10 can put in the closed configuration and kept as a resource. In the closed configuration, the first and second bottom portions 22,23 of the rigid panels 12,14 and the plurality of pages 24 are inserted into and covered by the base 30, and thereby creating a book with an aluminum spine with the specific calendar year etched or imprinted into the bottom of the base 30, as shown in FIG. 7*b*. The calendar 10 in the closed configuration can then be placed onto a shelf for later reference.

FIG. 8 illustrated the calendar 10 is the closed configuration and laying upon the second rigid side 14. The base 30 is attached to the lower portions 22,23 of the first and second rigid ends 12,14 by snuggly fitting over and around the lower portions 22,23. The calendar year "2014" is printed or etched on the bottom surface of the base 30. Additionally, the calendar year "2014" can be imprinted or etched on the outer surface of the first rigid panel 12.

FIG. 9 is a perspective view of the calendar 10 shown in FIG. 8 standing upright in the closed configuration. The bottom of the base 30 is visible showing the calendar year "2014" imprinted or etched upon the bottom. Also, the outer surface of the flat rigid panel 12 can be imprinted or etched to show the calendar year, such as "2014," on the outer surface. In this closed and upright configuration the calendar 10 is ideal for placing upon a shelf for later reference and easy access and display.

While specific embodiments have been shown and described to point out fundamental and novel features of the invention as applied to the preferred embodiments, it will be understood that various omissions and substitutions and changes of the form and details of the invention illustrated and in the operation may be done by those skilled in the art, without departing from the spirit of the invention.

The invention claimed is:

1. A notebook and a base, comprising:

a first rigid panel having a first top portion and a first bottom portion;

a second rigid panel having a second top portion and a second bottom portion, wherein the first top portion and the second top portion are rotatably connected;

a planar base having first and second opposing parallel sidewalls connected perpendicular to and along the planar base, said first and second opposing parallel sidewalls each including a first slot sized for receiving the first bottom portion and a second slot sized for receiving the second bottom portion;

a plurality of pages each having a third top portion and a third bottom portion, wherein the third top portion of the plurality of pages are rotatably connected to the first top portion of the first rigid panel and the second top portion of the second rigid panel; and wherein the first slot and the second slot on each of the opposing parallel sidewalls angle toward each other as extending away from the planar base.

2. The notebook and base of claim 1, where the first top portion of the first panel, the second top portion of the second rigid panel, and the third top portion of the plurality of pages are rotatably connected using a ring.

3. The notebook and base of claim 2, wherein the ring includes a spiral ring.

4. The notebook and base of claim 3, wherein the first top portion of the first rigid panel, the second top portion of the second rigid panel, and the third top portion of the plurality of pages each include a plurality of apertures for receiving the spiral ring, and thereby rotatably connect the first rigid panel, the second rigid panel, and the plurality of pages.

5. The notebook and base of claim 2, wherein the first rigid panel, the second rigid panel, and the base are constructed of metal.

6. The notebook and base of claim 2, wherein the pages are constructed of paper.

7. The notebook and base of claim 2, wherein the plurality of pages display a calendar.

8. The notebook and base of claim 2, wherein the first and second opposing sidewalls of the base are spaced apart at a distance so as to enable the base to fit snuggly over the first bottom portion, the second bottom portion, and the third bottom portion when the notebook is in closed configuration.

9. The notebook and base of claim 1, wherein the first rigid panel and the second rigid panel are planar.

10. The notebook and base of claim 1, wherein the first bottom portion of the first rigid panel is located within the first slots and the second bottom portion of the second panel is located within the second slots when the notebook is in a self-standing configuration.

* * * * *